US009320368B2

(12) United States Patent
Marotti et al.

(10) Patent No.: US 9,320,368 B2
(45) Date of Patent: Apr. 26, 2016

(54) MAGNETIC DISPLAY UNIT

(71) Applicant: The Procter & Gamble Company, Cincinnati, OH (US)

(72) Inventors: Martin Jay Marotti, Carmel, IN (US); Ralph Albert Sagel, Loveland, OH (US); Raymond Charles Bell, Cincinnati, OH (US)

(73) Assignee: THE PROCTER & GAMBLE CO, Cincinnati, OH (US)

( * ) Notice: Subject to any disclaimer, the term of this patent is extended or adjusted under 35 U.S.C. 154(b) by 309 days.

(21) Appl. No.: 13/848,200

(22) Filed: Mar. 21, 2013

(65) Prior Publication Data

US 2014/0284440 A1 Sep. 25, 2014

(51) Int. Cl.

| | |
|---|---|
| ***A47G 1/17*** | (2006.01) |
| ***A47F 5/00*** | (2006.01) |
| ***A47B 73/00*** | (2006.01) |

(52) U.S. Cl.

CPC ..... *A47F 5/0006* (2013.01); *A47B 73/004* (2013.01); *A47B 73/008* (2013.01)

(58) Field of Classification Search

CPC ..... A47F 5/006; F16L 3/01; F16B 5/08; A47B 73/004; A47B 73/008

USPC ..... 248/206.5, 235, 247; 211/59.3, DIG. 1, 211/74, 75, 85.29

See application file for complete search history.

(56) References Cited

U.S. PATENT DOCUMENTS

| | | | | |
|---|---|---|---|---|
| 2,620,691 | A | 12/1952 | Gould | |
| 4,019,638 | A * | 4/1977 | Miller | 211/74 |
| 4,488,653 | A * | 12/1984 | Belokin | 211/184 |
| 5,368,203 | A * | 11/1994 | Friedrich et al. | 222/179.5 |
| 5,669,527 | A | 9/1997 | Hardy | |
| 5,706,958 | A | 1/1998 | Spamer | |
| 6,155,438 | A * | 12/2000 | Close | 211/59.3 |
| 7,802,697 | B2 * | 9/2010 | Martin | 221/193 |
| 2005/0247843 | A1 * | 11/2005 | Bertrand et al. | 248/324 |
| 2007/0170132 | A1 * | 7/2007 | Bertrand et al. | 211/70.6 |
| 2007/0228242 | A1 | 10/2007 | Martin | |
| 2011/0266238 | A1 | 11/2011 | Lopez | |

OTHER PUBLICATIONS

International Search Report and Written Opinion, mail date Apr. 28, 2014, 9 pages.

* cited by examiner

*Primary Examiner* — Gwendolyn Baxter
(74) *Attorney, Agent, or Firm* — James E. Oehlenschlager

(57) ABSTRACT

A shelf display unit having one or more magnetic connectors allowing the display unit to be releasably attached to a shelf for the display of products.

9 Claims, 10 Drawing Sheets

MAGNETIC DISPLAY UNIT

FIELD OF THE INVENTION

The invention is directed to detachable shelf display units, wherein the individual shelf display units comprise one or more magnets.

BACKGROUND OF THE INVENTION

Shelf space on retail store shelves is an important factor in determining whether a consumer purchases a product, resulting in competition for the most favorable space. Product manufacturers are constantly competing for the amount of shelf space and the position of their products on the shelf. No matter where the product is located on the shelf the product still needs to capture a consumers attention. This has to be done rather quickly as the average amount of time a consumer spends looking for a particular product is usually measured in seconds.

Manufacturers are always looking for ways to improve the "wow factor" of their products on the store shelves. This can be done through easily recognized labeling to lead consumers to their brand or through the use of bright or attention getting logos. Another avenue of approach involves how the products are presented at the shelf, for example products from the same manufacturer can be grouped together to send a collective message to the consumer that the products might not be able to communicate on their own. However this method generally requires a rather large amount of shelf space and a retailer that is selling at least several of the manufacturer's brands. Another method involves easing the burden on the consumer when selecting a product. For instance the products could be displayed in custom built displays provided by the manufacturer that group similar products together, to reduce selection time and make the products easy to remove, such as seen in certain soup brands. However, these displays can be costly and once again rely on the retailer dedicating a significant amount of shelf space and purchasing several different types of product.

What is needed is a display unit that is capable of displaying products in a manner that attracts a consumers attention and maximizes shelf space.

SUMMARY OF THE INVENTION

A shelf display unit is provided that comprises a top wall and two opposing side walls; at least one magnetic connector connected to the top wall; one or more channels with each channel having a channel gap; wherein the one or more channels and channels gaps have a length and width.

A shelf display unit is provided that comprises a top wall and two opposing side walls; at least one magnetic connector positioned on the top wall; one or more channels having two opposing flat side surfaces with each channel having a channel gap; a product engaged with the channel, the product having at least one flat surface that opposes at least one of the channel flat side surfaces.

DETAILED DESCRIPTION OF THE INVENTION

The present invention is directed to detachable shelf display units comprising one or more magnetic connectors. The magnetic connectors allow the unit to be easily detached and reattached to a shelf positioned above the shelf display unit. The products displayed by the shelf display unit hang down from the unit so that they are in full display to a consumer. Wherein a product includes any item suitable for sale on a retail shelf having a container, for example oral care products (toothpaste, mouthwash, denture compositions); beauty care products (shampoo, conditioner, skin care compositions); household care products (detergent, cleaning compositions); etc. . . . .

Figure 1:
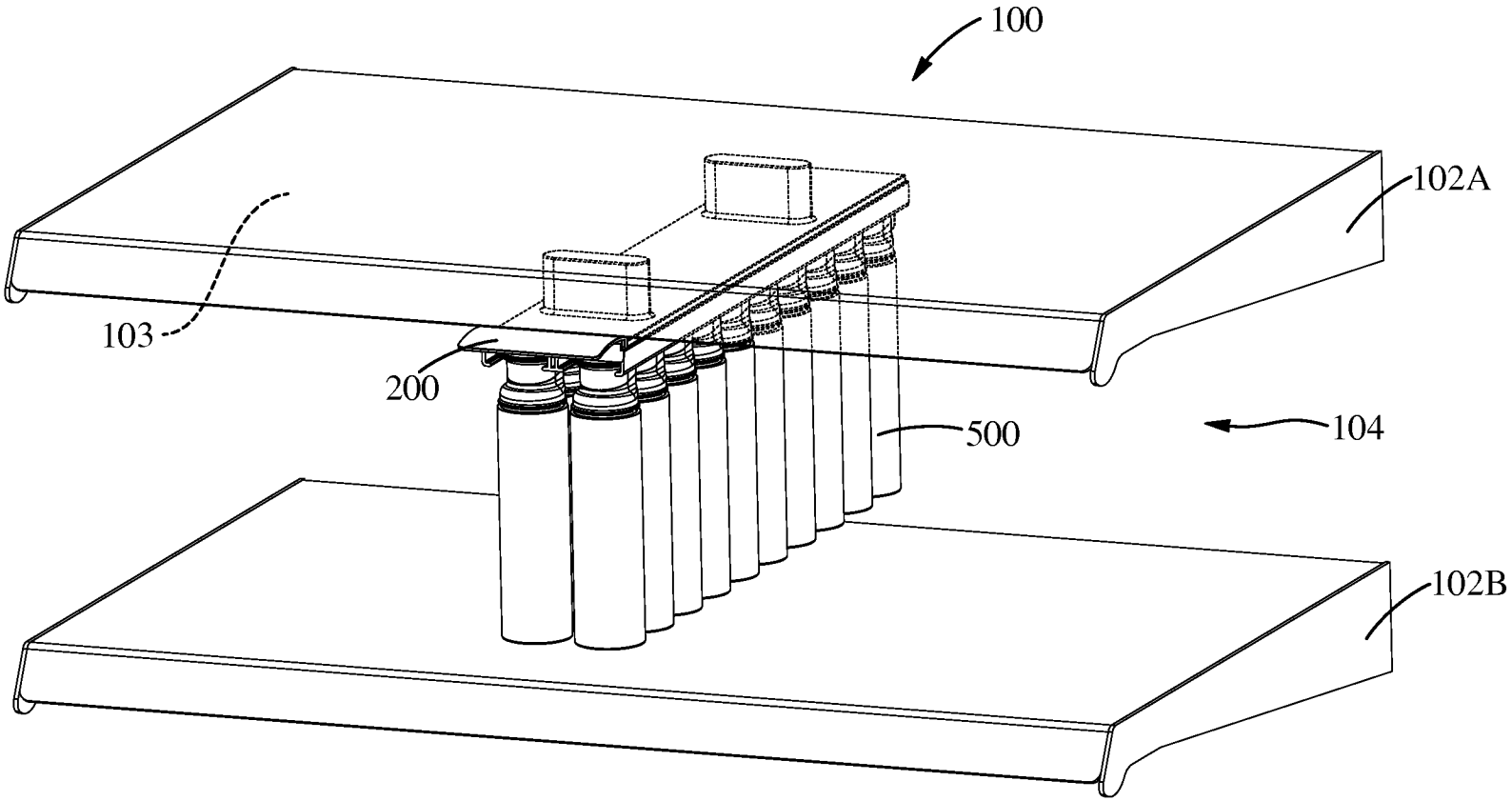
FIG. 1 is a perspective view of a retail shelf display having a shelf display unit embodiment.

FIG. 1 shows a retail shelf display 100, which includes multiple shelves 102A, 102B creating a display area 104. The shelf display 100 also includes one or more shelf display units 200. Each display unit 200 is removably attached to a bottom surface 103 of the shelf 102A above it and contains one or more products 500 that hang from the display unit 200. While FIG. 1 illustrates the shelf display 100 as being stocked with a single display unit 200, it should be appreciated that a shelf display 100 can be stocked with more than one shelf display unit. Moreover, while the shelf display units 200 are illustrated as being attached to the top-most shelf 102A, the display units 200 can be attached to any of the shelves 102, an inside surface of the shelf display 100, or any combination thereof.

Figure 2:
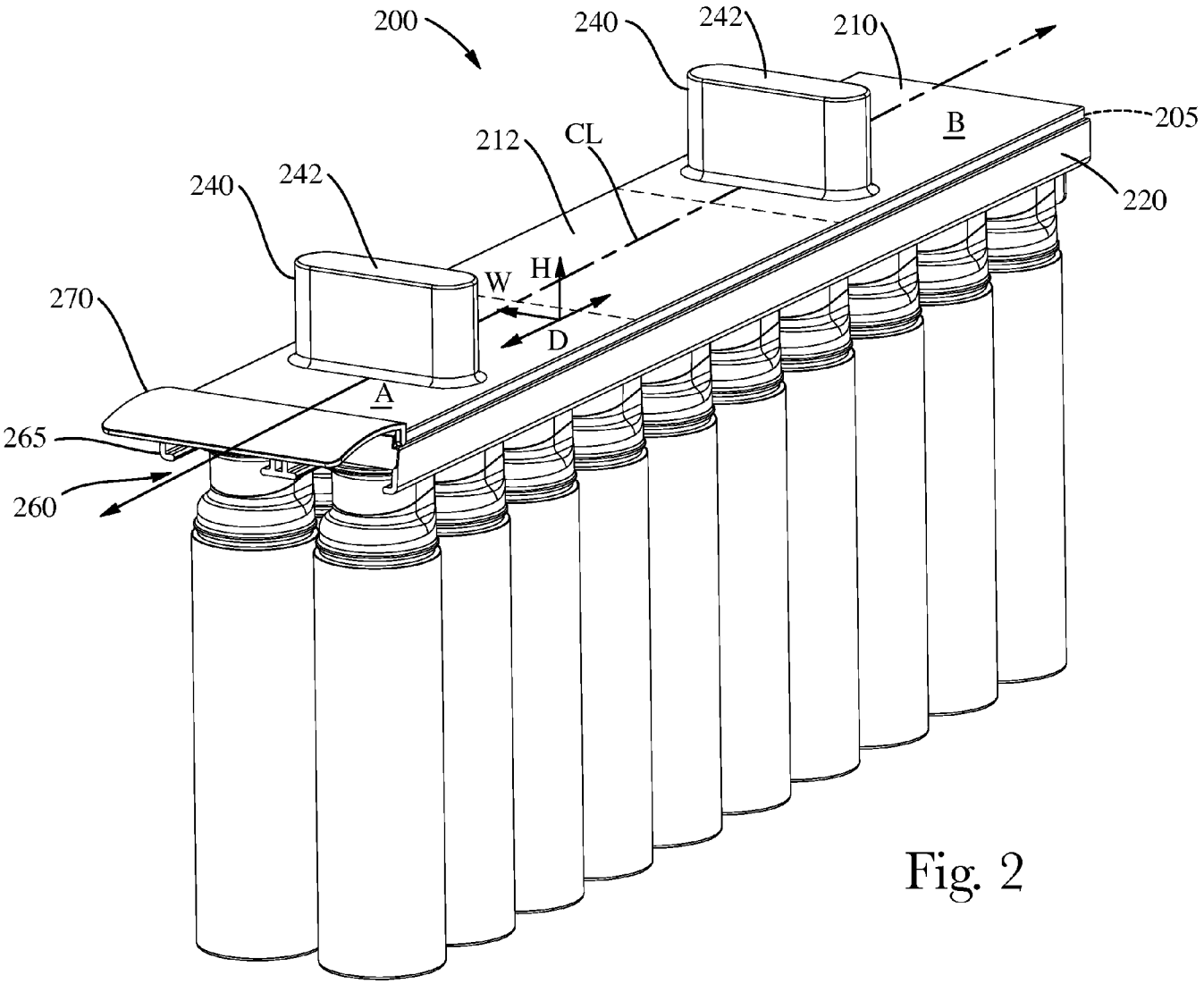
FIG. 2 is a perspective view of a shelf display unit embodiment.
Figure 3:
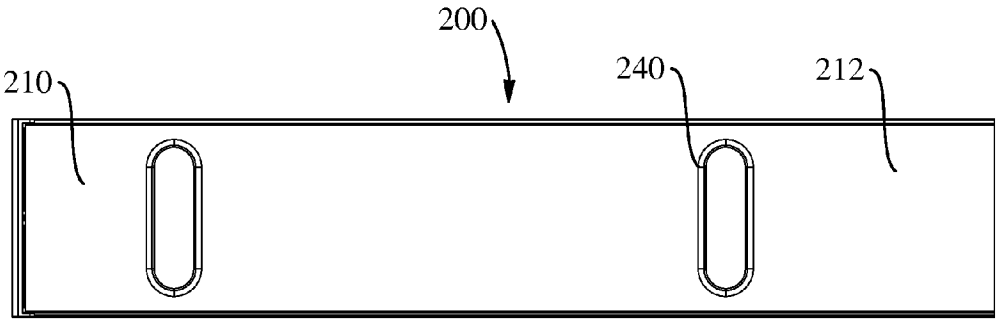
FIG. 3 is a top view of a shelf display unit embodiment.
Figure 4:
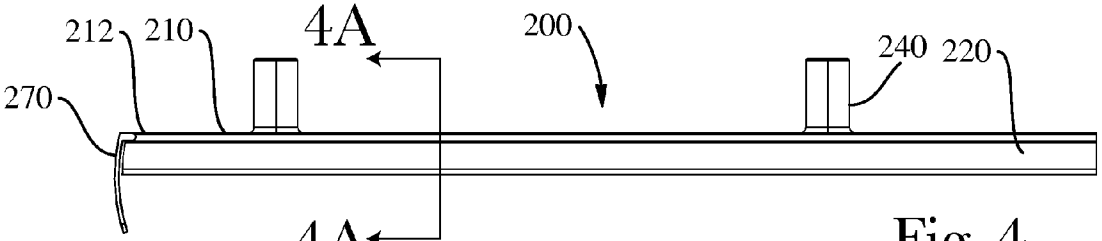
FIG. 4 is a side view of a shelf display unit embodiment.
Figure 7:
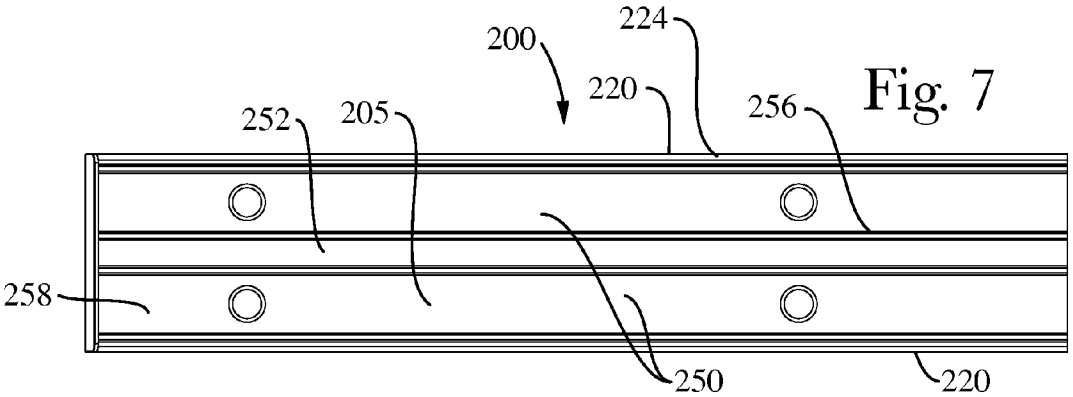
FIG. 7 is a bottom view of a shelf display unit embodiment.

An embodiment of a shelf display unit 200 is shown in FIG. 2. In this embodiment, as shown in FIGS. 2-4, the display unit 200 comprises a top wall 210 having a center line (CL) and two opposing side walls 220. The shelf display unit can be made of any material known in the art such as plastic, wood, metal, or any other commonly used material. Connected to the shelf display unit 200 by being positioned on, in, or through the outer surface 212 of the top wall 210 are one or more magnetic connectors 240, in this embodiment two magnetic connectors (connectors). The magnetic connectors 240 are brought in close proximity to a metal shelf surface, such as the bottom surface 103 (see FIG. 1), wherein they will attach to the shelf surface providing a means of support for the display unit. Magnetic connectors may be composed of a magnet or a magnet plus one or more other components, for example a covering, such as paint, rubber, or plastic; a part or parts of the top portion; or combinations thereof. The magnetic connectors serve to provide a shelf display unit with a secure, but removable hold to a shelf surface, allowing consumers to view and then remove display product. A magnetic connector may be integral with the outer surface of the shelf display unit top wall, i.e. at least a portion of the magnetic connector and the display unit top wall are formed as a single piece, such as by an extrusion process, injection molding process, or any other suitable process; or a magnetic connector may be separately fixedly attached to the outer surface by any conventional means, such as adhesive. A magnetic connector may also be fixedly attached to another portion of the display unit, such as the inner surface 205 of the top wall, and protrude through a hole or gap in the top wall.

There may be any suitable number of connectors present on a shelf display unit, in certain embodiments from 1 to 10, 2 to 8, or 3 to 6, for instance there may be 2, 3 or even 4 connectors on a shelf display unit. A magnetic connector may be any desirable shape, for instance, as shown in FIG. 2 a magnetic connector 240 may have a roughly rectangular cross-sectional shape, or a circular or ellipsoid cross sectional shape. The cross-sectional shape, width (W), and depth (D) may also vary along the magnetic connector's height (H)—FIG. 2. The top most portion of a magnetic connector may also be above, commensurate with, or below the outer surface of the top wall. For example a magnetic connector 240 may be raised above the outer surface 212 of the top wall 210, as shown in FIG. 2. As shown in FIG. 2, in certain embodiments the height (H) of a magnetic connector 240, which is the distance between the outer surface 212 of the top wall 210 and the surface of the magnetic connector intended to attach to a shelf surface (connection surface) 242, is great enough to extend the opening 260 (or the opening flap 270 if present) past any obstructions created by the upper shelf, such as a shelf lip. The magnetic connectors may also be present below the outer surface of the top wall, for example in a depression.

Further a magnetic connector may be positioned in any desirable manner along the top wall of a shelf display unit. A magnetic connector may be positioned along the edges of the top wall, along the center line, or perpendicular to the center line. For example, as shown in FIG. 2 one magnetic connector 240 may be positioned within the front one-third (A) of the display unit 200 and one magnetic connector 240 positioned towards the back one-third (B) of the display unit 200; or in still further embodiments one or more connectors may extend in a linear manner along the center line of the display unit. Further if there are two or more magnetic connectors the magnetic connectors may vary in height so as to provide the display unit a tilt or angle when attached to a shelf surface. For instance, in the embodiment described above having a front and back magnetic connector the front connector can have a greater height so as to angle the front of the display unit downwards. In certain embodiments a magnetic connector does not have to contact a shelf surface directly, there can be one or more intermediate materials between the magnetic connector and the shelf surface, for example a pad or a plastic covering.

Figure 8:
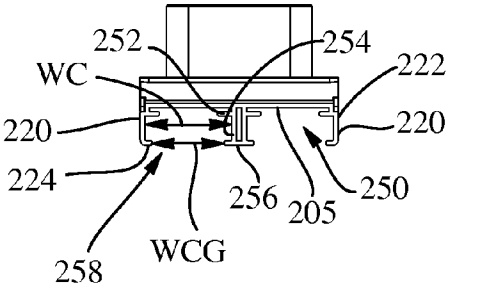
FIG. 8 is a frontal view of a shelf display unit embodiment.
Figure 4A:
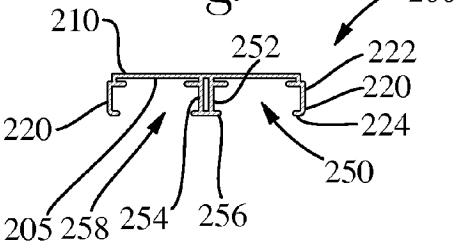
FIG. 4A is a cross-sectional view of FIG. 4 along section line A-A.
Figure 6:
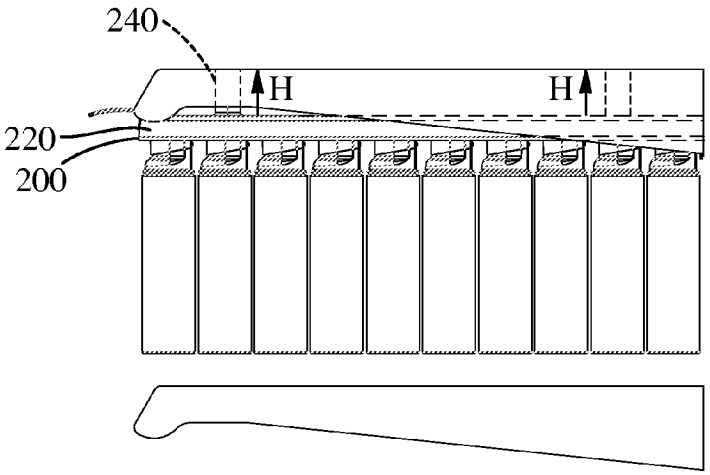
FIG. 6 is a side view of a retail shelf display having a shelf display unit embodiment.
Figure 5:
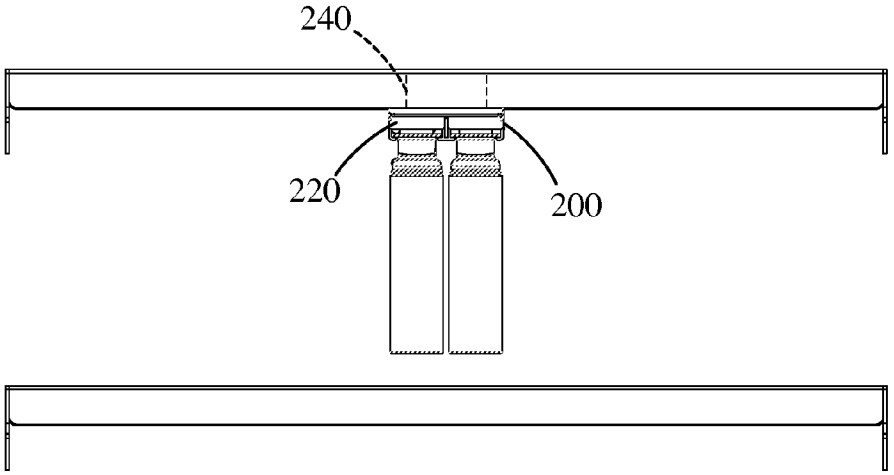
FIG. 5 is a frontal view of a retail shelf display having a shelf display unit embodiment.
Figures 9, 10, 11, 12:
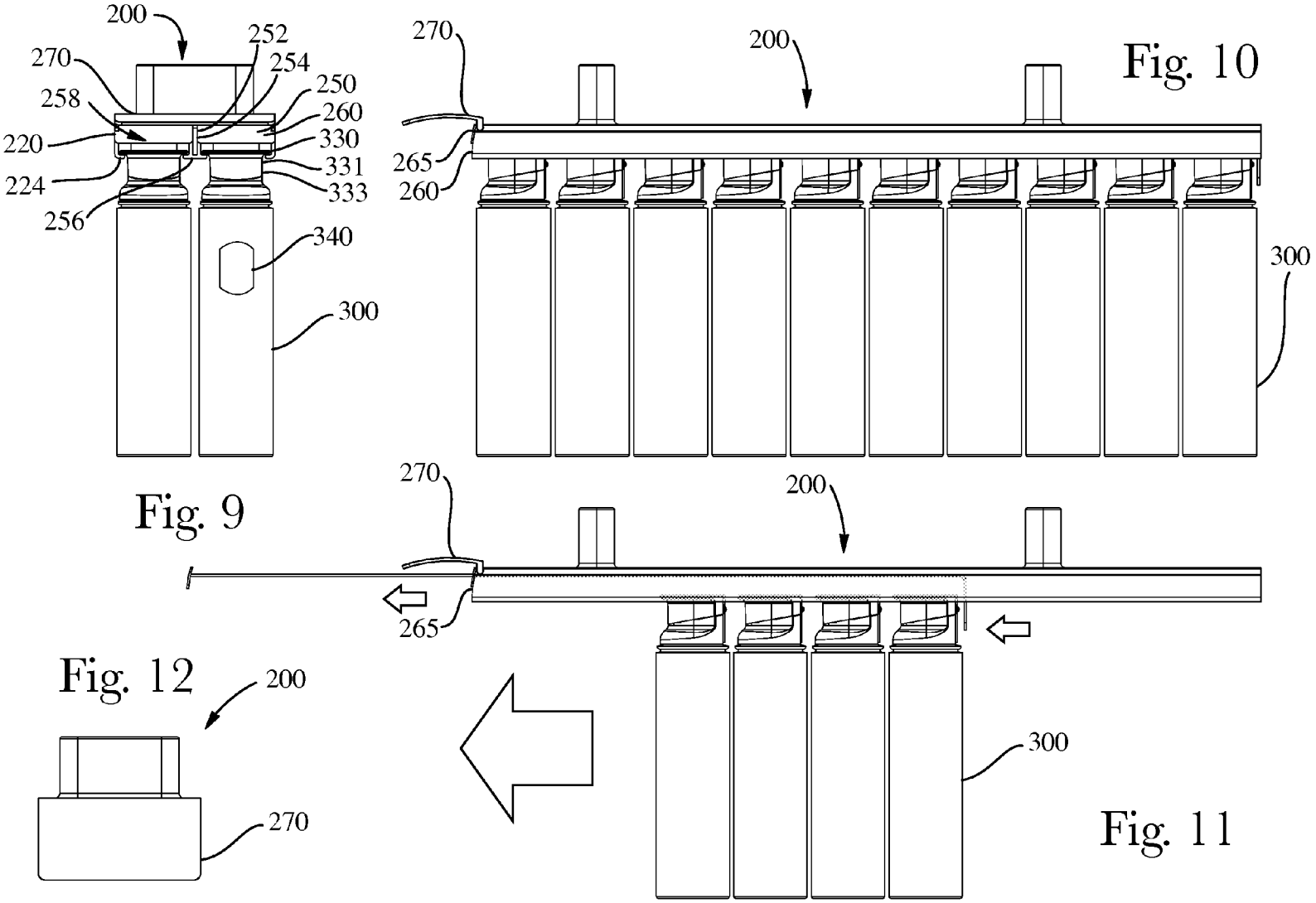
FIG. 9 is a frontal view of a shelf display unit embodiment.
FIG. 10 is a side view of a shelf display unit embodiment.
FIG. 11 is a side view of a shelf display unit embodiment.
FIG. 12 is a frontal view of a shelf display unit embodiment.

A display unit 200 can have one or more channels 250, as shown in FIGS. 4A (cross-sectional view of FIG. 4), 7 (Bottom view of a shelf display unit) and 8 (frontal view of a shelf display unit), while the FIGS. shows two channels other numbers can be used, for example one or three or more. In this embodiment the channels 250 are formed by a middle rail 252 positioned between two opposing side walls 220 and extending along the length of the display unit 200. The middle rail 252 is formed from a stem 254 extending downward from the inner surface 205 of the top wall 210 and a bar portion 256 extending from the stem portion 254. The stem 254 has a smaller width than the bar portion 256, forming a "T" in cross-section, allowing a portion of a product, such as a lip or edge, to be inserted into the stem portion 254 and then at least partially engage or rest on the bar portion 256. Flanking the middle rail 252 on both sides are the side walls 220. Each sidewall 220 has a downwardly extending arm portion 222 and an inward extending flange portion 224, so that the sidewall has a "C" shape in cross-section. The middle rail 252 and flanking sidewalls 220 form two channels 250. The bar portion 256 of the middle rail 252 and flange portions 224 of the side walls 220 serve to narrow or partially close the bottom portion of the channels 250, forming a channel gap 258. As shown in FIGS. 9 and 10 the channel gap 258 allows products 300 to be added to the channel 250 through the opening 260 and an extending portion 330 of the product 300, such as an edge or lip, can engage the bar portion 256 of the middle rail 252 and a flange portion 224 of a side wall 220, so as to be held in place in the channel 250. With reference to FIG. 8, the width (WCG) of a channel gap 258 and the width of a channel 250 (WC) should be enough to allow products 300 to be loaded into the shelf display unit 200 and, as shown in FIG. 11 to be freely moveable along the length of the shelf display unit 200, yet the channel gap width (WCG) should be narrow enough to support the product 300 being displayed as the product 300 hangs down from the shelf display unit 200. Further the width (WCG) of a channel gap 258 and width (WC) of a channel 250 can vary along the length of a shelf display unit 200. For example the width of the channel, channel gap, or both may be narrower in some sections but wider in others, for instance forming opposing waves or undulations to accommodate circular shaped products. The variations in width can be designed to hold products in place in a channel but are wide enough to allow the products to be moved by a person along the channel length—for instance if there is a desired spacing between products or if the shelf display unit is at an angle the product may congregate at the front of a display but the variations in channel width would hold the products in place. In certain embodiments the channel gap width can be from about 20 mm to about 40 mm or from about 25 mm to about 35 mm and the channel width can be from about 30 mm to about 50 mm or from about 35 mm to about 45 mm. In those embodiments where there is only a single channel there would be no rails and the opposing side walls would form the channel. In those embodiments where there is three or more channels two or more middle rails could be used.

As shown in FIGS. 9-11 displayed products 300 may be loaded into the shelf display unit 200 by sliding the product 300 into the opening 260 such that an extending portion 330 portion of the product 300 enters the channel 250. Wherein an extending portion 330 of the product 300 is small enough to fit in the channel 250 but wider than the width (WCG) of the channel gap 258, such that the extending portion 330 engages the bar portion 256 of the middle rail 252 and the flange portion 224 of a side wall 220 allowing the product 300 to be displayed within the shelf display unit 200. Likewise products can be removed from the shelf display unit 200 through the opening 260.

With reference back to FIG. 2 the shelf display unit 200 may have an opening flap 270 that partially or completely covers the channel opening 260. While FIG. 2 shows a single opening flap 270, there may be more than one opening flap, for instance in those embodiments where there is more than one channel each channel may have its own opening flap. The opening flap 270 may have a variety of frontal shapes (the shape of the opening flap when viewed by a consumer on the shelf when the opening flap is closed), for example the frontal shape may be rectangular, elliptical, triangular, circular, or any other suitable shape. Further, the opening flap may also have a variety of lateral cross-sectional shapes, for instance it can be substantially flat or bowed in a convex or concave manner. The opening flap may be movably connected with one or more points of connection positioned on the top wall, middle rail, or side walls. FIG. 2 shows the opening flap movably connected with both sidewalls. A point of connection can be any conventional method known in the art, such as shown in FIG. 2 a pin and hole engagement or for example the means of connection could be a dome and dimple arrangement. The opening flap rotates about the points of connection, such that the opening flap has a closed and open position. In the closed position, as shown in FIGS. 4 and 12, the opening flap 270 completely or partially covers the opening 260 and in the open position, as shown in FIGS. 2 and 9-11, the opening flap 270 disengages from the front face 265 of the shelf display unit 200 such that product 300 may be removed. In certain embodiments the opening flap may stay in place following rotation about the points of connection—such that, for example the flap may remain in an open position. An opening flap may stay in place through the use of various means such as friction or a click and lock system. In certain embodiments the flap may, following rotation about the points of connection return to the original closed position. The flap may also be locked in the closed position through a locking mechanism, such as a tongue and groove system. This would enable the display unit to be moved with product without fear of the product falling out. The opening flap may display a brand identifier for display to a consumer.

As shown in FIGS. 2 and 9-11 a portion of the products 300 to be displayed can have one or more surfaces that engage one or more channel surfaces, such as the channel gap 258 formed by the bar portion 256 of the middle rail 252 and flange portion 224 of a side wall 220 and the channel sides formed from the stem 254 of the middle rail 252 and a side wall 220. In certain embodiments these product surfaces can be complementary to the channel surfaces, such that when the product is loaded into the channel the product is forced into a preferred orientation, such that consumers will view a desired portion of the product, such as a label when viewing the display unit. For example, as shown in FIG. 9 a products cap 331 can have an overall rounded shape with one or more substantially flat surfaces 333 and the channel gap 258 can have a substantially constant width to form a slot with substantially flat side surfaces, such that when the product 300 is loaded in the shelf display unit 200 at least one flat surface 333 of the product cap 331 and channel gap 258 orient towards each other, such that the desired portion of the product 300, in this case the label 340 is displayed towards the consumer. Another example would be a product having a cap, wherein the product cap has a groove that complements a protrusion on the top wall or sidewall of the shelf display unit. As only a small portion of the product is engaged with the channel the rest of the product is able to hang from the display unit allowing a consumer to view any markings or labels on the product. Further as the product is not resting on the shelf, but rather hanging from the display unit the product does not require a flat bottom end, and may have a wide range of shapes, such that the product may be asymmetric, ovoid, or any other suitable shape.

Figure 13:
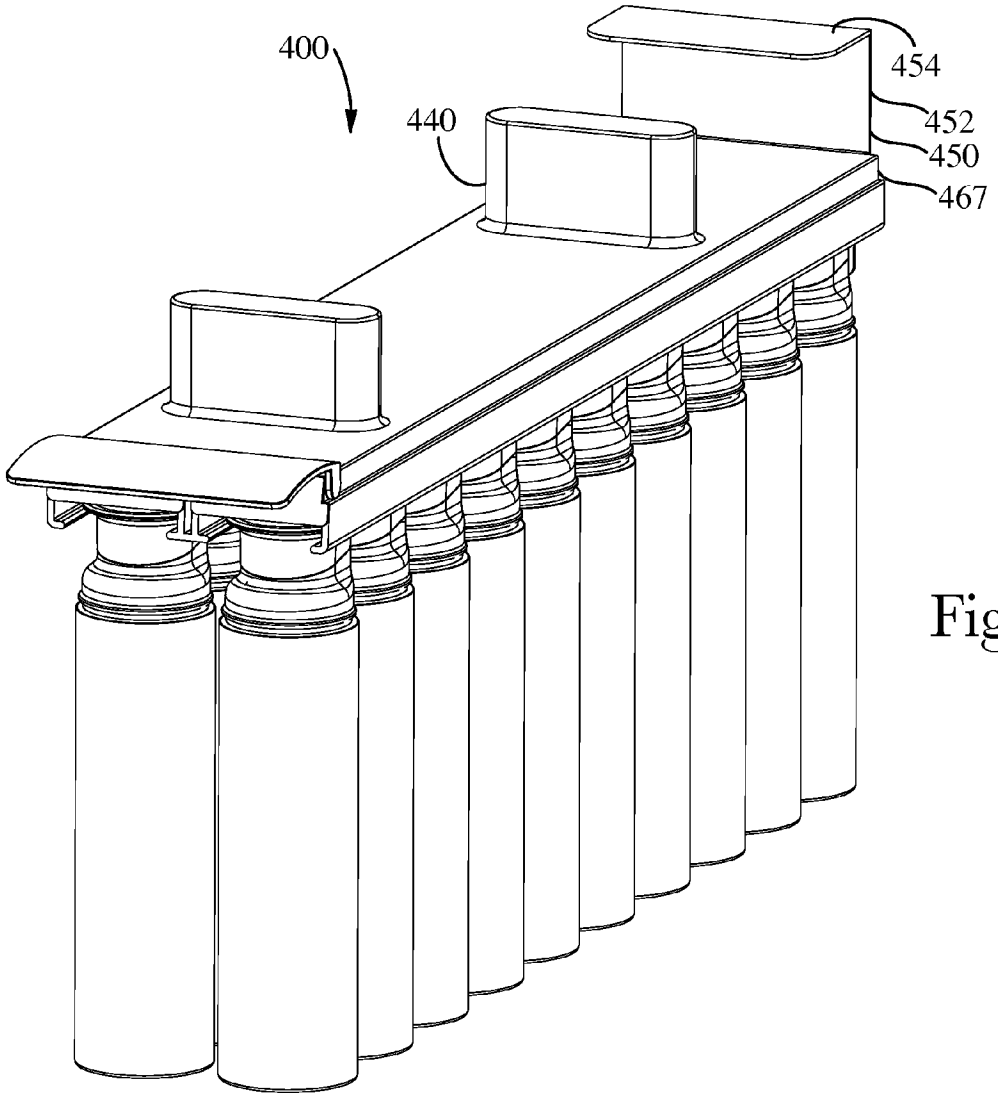
FIG. 13 is a perspective view of a shelf display unit embodiment.
Figure 14:
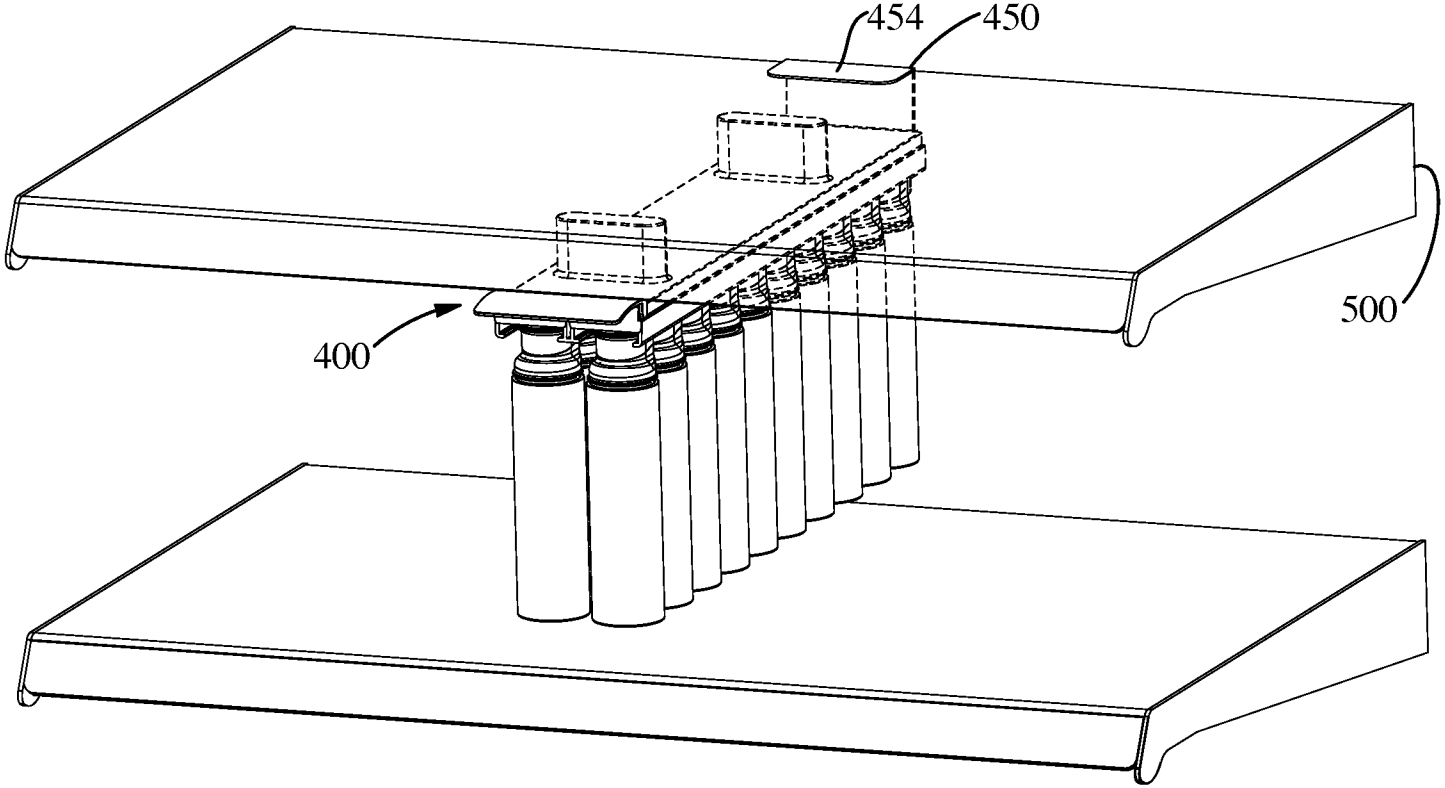
FIG. 14 is a perspective view of a retail shelf display having a shelf display unit embodiment.
Figures 15, 16:
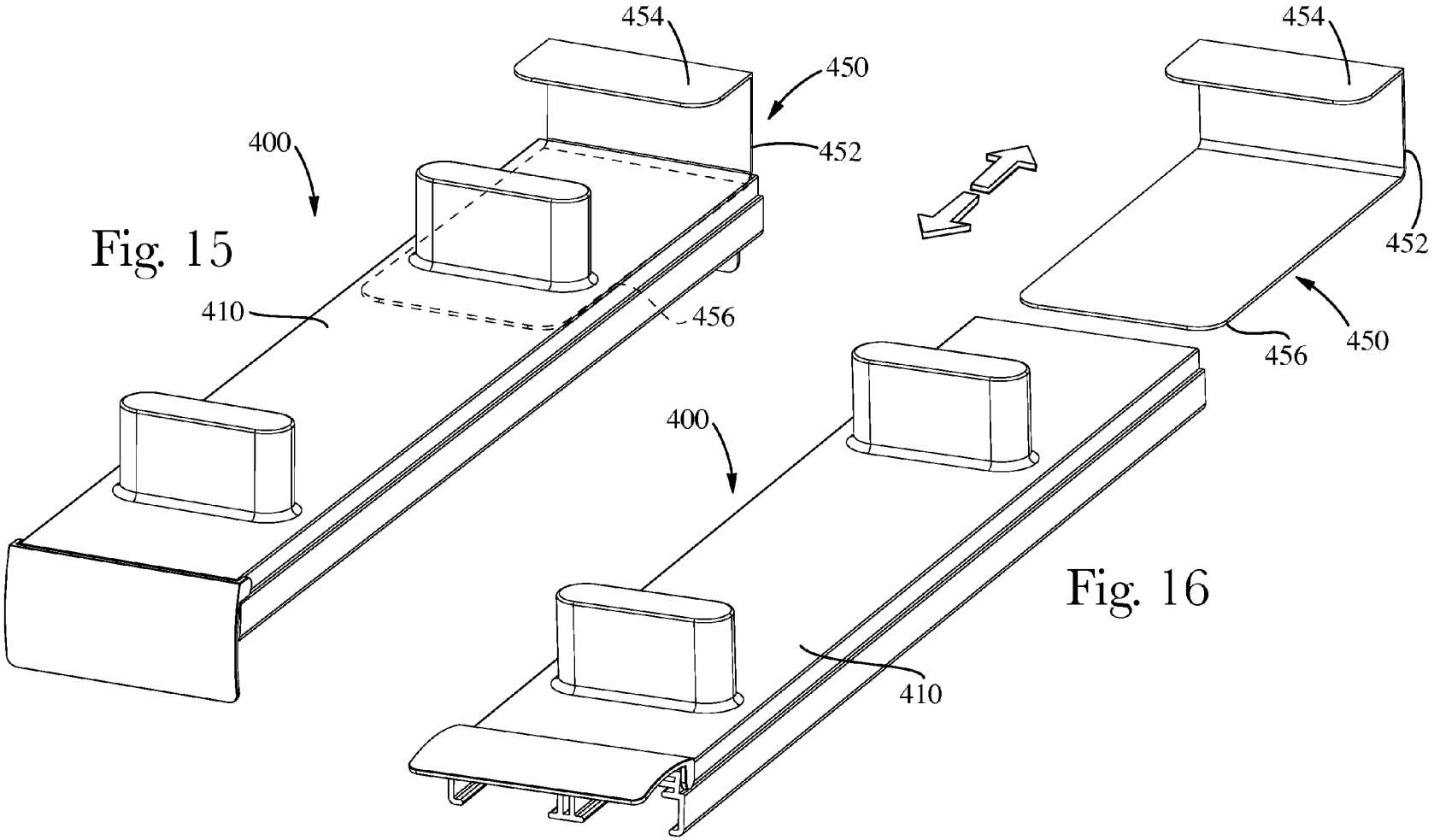
FIG. 15 is a perspective view of a shelf display unit embodiment.
FIG. 16 is a perspective plan view of a shelf display unit embodiment.

In certain embodiments as show in FIGS. 13 and 14 a shelf display unit 400 may have an armature 450 extending from the rear face 467 of the shelf display unit 400. The armature 450 can be in place of or in addition to a rear positioned magnetic connector 440. The armature 450 has a back 452 extending upwards from the rear or rear face 467 of the shelf display unit 400 towards the shelf 500 above the shelf display unit 400, then a lip 454 extends towards the shelf 500 above the shelf display unit 400. The lip is designed to engage a portion of the shelf, thereby providing support to the display unit. In certain embodiments the armature may be integral with or a separate piece attached to the shelf display unit. In certain embodiments, as shown in FIGS. 15 and 16 the armature 450 may be extendible, such that the armature 450 comprises an extension 456. The extension allows the armature length to be adjusted, such that the armature can work with different sized display units and shelves and also allows increased flexibility when positioning the display unit, as the display unit can be positioned closer or farther away from the shelf front depending on the adjusted armature length. The armature may be any suitable size or thickness to provide support to the shelf display unit. For example the armature may be substantially flat or it may be tubular. Further the armature may be made from any suitable material, such as plastic, wood, or metal. The armature may be fitted to the top or bottom surface of the top wall or within the top wall of the display unit. The armature may be fitted to the top wall of the display using any conventional means. For example if the armature is fitted to the top or bottom surface one or more clasps may be used and if it is fitted within the top wall 410, as shown in FIGS. 15 and 16, there can be an opening or groove within the top wall 410 from which the extension can be extended or retracted.

Figures 17, 18:
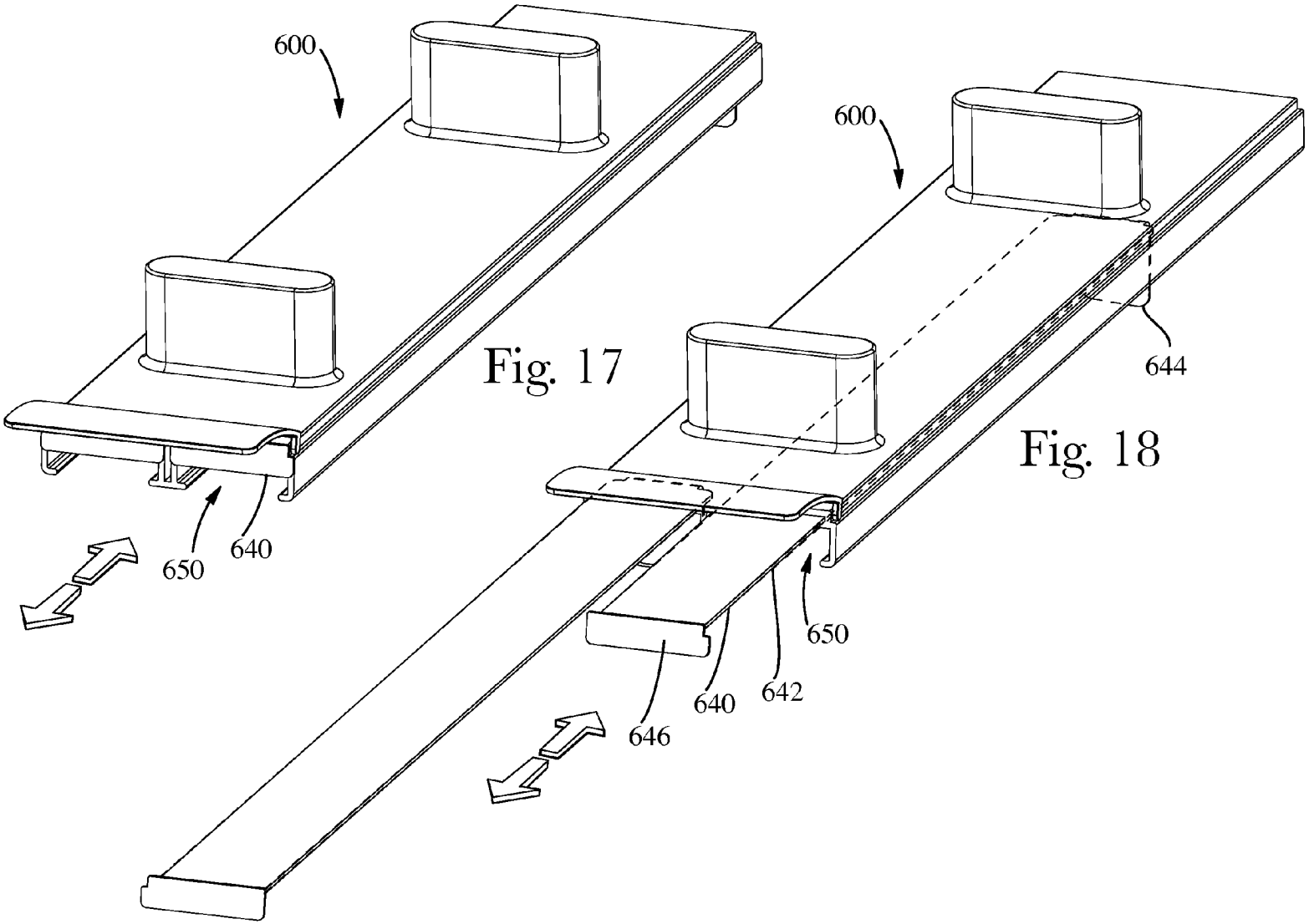
FIG. 17 is a perspective view of a shelf display unit embodiment.
FIG. 18 is a perspective view of a shelf display unit embodiment.
Figure 19:
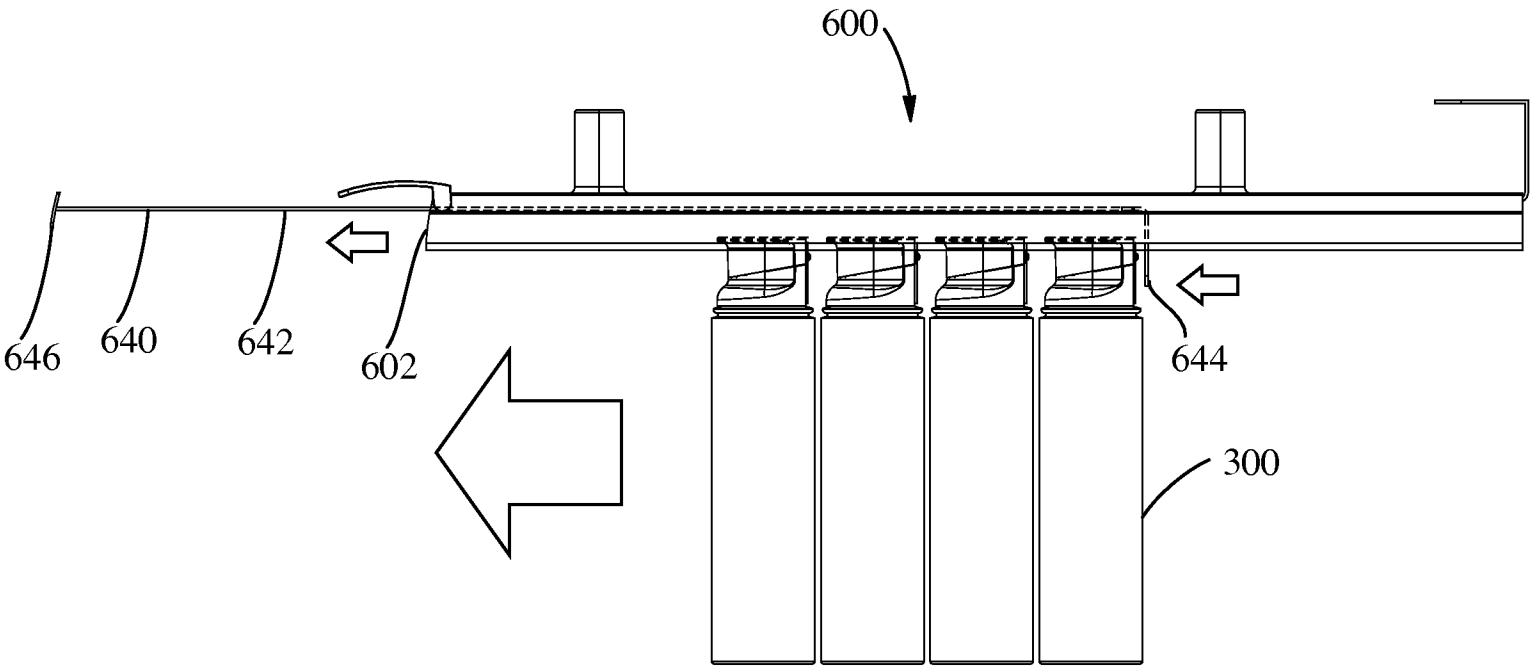
FIG. 19 is a side view of a shelf display unit embodiment.

In certain embodiments, as shown in FIGS. 17 and 18 one or more channels 650 of a shelf display unit 600 may have a condenser 640. A condenser comprises a lateral plate 642 connecting a back support 644 and a tab 646. A condenser 640 should be a of a size to fit within a channel 650 and may be positioned within the channel 650 (either along a side wall or the top wall) using any suitable means such as a slot, clasps, or a tongue and groove system that allows the condenser 640, specifically the back support 644 to be moved along the length of the channel 650. As shown in FIG. 19 a condenser 640 is used to move existing product 300 towards the front 602 of the shelf display unit 600 as more product 300 is removed. The tab 646 should be of a size that allows product 300 to be loaded into a channel and the back support 644 should be of a size that allows it to engage product 300 and move it towards the front 602 of the shelf display unit 600. To use, the tab 646 is pulled forward until the product 300 is moved sufficiently forward by the back support 644 and then the tab 646 is pushed back into the shelf display unit 600 so that it no longer extends from the front 602.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shelf display unit comprising:

a. a top wall and two opposing side walls;

b. at least one magnetic connector connected to the top wall;

c. one or more channels with each channel having a channel gap;

wherein the one or more channels and channels gaps have a length and width; and wherein the one or more channels are formed from at least one of a sidewall or middle rail, each of which extends downwardly from the inner surface of the top wall.

2. The shelf display unit of claim 1, wherein the width of the channel is greater than the width of the channel gap.

3. The shelf display unit of claim 2, wherein the width of channel is from about 30 mm to 50 mm and the width of the channel gap is from about 20 mm to 40 mm.

4. The shelf display unit of claim 1, wherein the shelf display unit has two channels.

5. The shelf display unit of claim 1, wherein the shelf display unit has an opening flap.

6. The shelf display unit of claim 1, wherein the shelf display unit has an armature.

7. The shelf display unit of claim 6, wherein the armature comprises an extension and is extensible.

8. The shelf display unit of claim 7, wherein the extension is fitted within an opening in the top wall.

9. The shelf display unit of claim 1, wherein the shelf display unit has two magnetic connectors.

* * * * *